US006400067B1

(12) United States Patent
Manning et al.

(10) Patent No.: US 6,400,067 B1
(45) **Date of Patent: *Jun. 4, 2002**

(54) HIGH POWER SHORT ARC DISCHARGE LAMP WITH HEAT SINK

(75) Inventors: William Lawrence Manning, Walpole; David Paul Vidal, Amesbury, both of MA (US)

(73) Assignee: PerkinElmer, Inc., Wellesley, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/170,269

(22) Filed: Oct. 13, 1998

(51) Int. Cl.[7] ..... H01J 1/02; H01J 61/52; H01J 7/24; H01K 1/58

(52) U.S. Cl. ..... 313/46; 313/113

(58) Field of Search ..... 313/46, 45, 113; 362/264

(56) References Cited

U.S. PATENT DOCUMENTS

| | | | | |
|---|---|---|---|---|
| 3,731,133 A | * | 5/1973 | McRae et al. | 313/113 |
| 3,808,496 A | * | 4/1974 | McRae et al. | 313/113 |
| 4,599,540 A | | 7/1986 | Roberts | 313/570 |
| 4,633,128 A | | 12/1986 | Roberts et al. | 313/113 |
| 4,935,853 A | * | 6/1990 | Collins | 362/272 |
| 5,299,279 A | * | 3/1994 | Roberts | 392/421 |
| 5,367,444 A | * | 11/1994 | Bornhorst et al. | 362/264 |
| 5,399,931 A | | 3/1995 | Roberts | 313/46 |
| 5,721,465 A | | 2/1998 | Roberts | 313/46 |
| 5,945,776 A | * | 8/1999 | Koster et al. | 313/113 |

OTHER PUBLICATIONS

Capobianco, R.A., "Xenon: The Full Spectrum vs. Deuterium Plus Tungsten", EG&G Optoelectronics Jun. 1997.

Capobianco,R.A.,"Optical Coupling of Flashlamps and Fiber Optics", EG&G Optoelectronics Jun. 1997.

Capobianco, R.A.,"High–Stabilityt Pulsed Light Systems", EG&G Optoelectronics Jun. 1997.

Advertisement 1100 Series High Stability Short Arc Xenon Flashlamps, EG&G Optoelectronics Feb. 1994.

Advertisement, LabPac PS 1200 Laboratory Flashlamp Power Supply, EG&G Optoelectronics Jan. 1997.

Advertisement, 1100 Series Power Supplies, EG&G Optoelectronics Feb. 1994.

* cited by examiner

*Primary Examiner*—Nimeshkumar D. Patel
*Assistant Examiner*—Karabi Guharay
(74) *Attorney, Agent, or Firm*—Iandiorio & Teska

(57) ABSTRACT

A high power short arc gas discharge lamp includes an electrically insulating reflector body having a concave internal reflector surface with a focal point; an anode and a cathode spaced from the anode to create an arc gap between them proximate the focal point; the reflector body having a conical external surface for reducing the thickness of the reflector body between the concave internal surface and the conical external surface; and an external electrically isolated heat sink mounted on the external conical surface proximate the arc gap.

8 Claims, 2 Drawing Sheets

HIGH POWER SHORT ARC DISCHARGE LAMP WITH HEAT SINK

FIELD OF INVENTION

This invention relates to an improved high power short arc gas discharge lamp, and more particularly to such a lamp with improved heat dissipation.

BACKGROUND OF INVENTION

Conventional short arc lamps, using xenon, argon or other gases, produce a broad spectrum light of 200 nm to 1100 nm or more at 1 to 2 Kw using a curved, concave reflector such as a parabolic or elliptical shape surrounding the arc Substantial heat is generated by these devices and can cause rapid electrode erosion and even catastrophic failure. The reflective surface is typically a silvered coating on a ceramic body which electrically insulates the cathode assembly from the anode assembly and the reflective coating from both assemblies. The most intense heat is generated proximate the arc. The heat dissipation problem is exacerbated by the fact that neither the ceramic nor xenon or other gas are very good thermal conductors.

In one approach the heat is removed using a large mass of highly thermally conductive material such as copper or aluminum in the anode assembly. In such devices the mass is somewhat removed from the area of the arc and the heat sink is partly surrounded by Kovar, a material which is approximately only 2% of the thermal conductivity of copper. In another approach the massive copper heat sink in the anode assembly is extended into an internal cavity to contact the wall of the ceramic reflector and conduct heat to the outer wall of the ceramic. This still requires that heat pass twice through the ceramic material before it can be externally dissipated. In addition, the extended portion has a narrow cross-section which acts as a heat choke. In a variation of that approach the second area of ceramic is replaced by a metal heat sink so the heat need travel only once through the ceramic material but the entire heat sink is a part of the anode assembly and is at the same potential which when the trigger pulse is present can be as high as 30 Kv. Here, too, the copper extension is narrow and acts as a thermal choke and the replacement metal heat sink is actually Kovar because of the need to braze it to the ceramic and Kovar has but 2% of the thermal conductivity of copper. See U.S. Pat. Nos. 4,633,128; 5,399,931; 4,599,540; 3,731,133; and 5,721,465.

SUMMARY OF INVENTION

It is therefore an object of this invention to provide an improved high power short arc gas discharge lamp.

It is a further object of this invention to provide such a high power short arc gas discharge lamp with improved heat dissipation.

It is a further object of this invention to provide such a high power short arc gas discharge lamp which dramatically reduces the possibility of electrode erosion and catastrophic failure.

It is a further object of this invention to provide such a high power short arc gas discharge lamp which locates heat sink material close to the area of the arc.

It is a further object of this invention to provide such a high power short arc gas discharge lamp which reduces the amount of low thermal conductivity material between the area of the arc and heat sink.

It is a further object of this invention to provide such a high power short arc gas discharge lamp which is smaller and more compact.

It is a further object of this invention to provide such a high power short arc gas discharge lamp in which the heat sink is externally mounted yet engages the area closest to the inner reflective surface.

It is a further object of this invention to provide such a high power short arc gas discharge lamp in which the heat sink is electrically isolated from the anode.

The invention results from the realization that a more thermally efficient high power short arc gas discharge lamp can be achieved using an electrical insulating reflector body having a concave internal reflective surface and a conical external surface which reduces the thickness of the body and placing an external, electrically isolated heat sink in conforming engagement with the conical surface proximate the gas discharge gap.

A high power short arc gas discharge lamp includes an electrically insulating reflector body having a concave internal reflector surface with a focal point. There is an anode and a cathode spaced from the anode to create an arc gap between them proximate the focal point. The reflector body has a conical external surface for reducing the thickness of the reflector body between the concave internal surface and the conical external surface. An external electrically isolated heat sink is mounted on the external conical surface proximate the arc gap.

In a preferred embodiment the internal reflector may be a parabolic surface or an elliptical surface. The reflective body thickness may be reduced proximate the arc gap. The heat sink may include a conical mounting surface for conformingly engaging the conical external surface. The heat sink may include a plurality spaced fins and it may be annular.

DISCLOSURE OF PREFERRED EMBODIMENT

Other objects, features and advantages will occur to those skilled in the art from the following description of a preferred embodiment and the accompanying drawings, in which.

Figure 1:
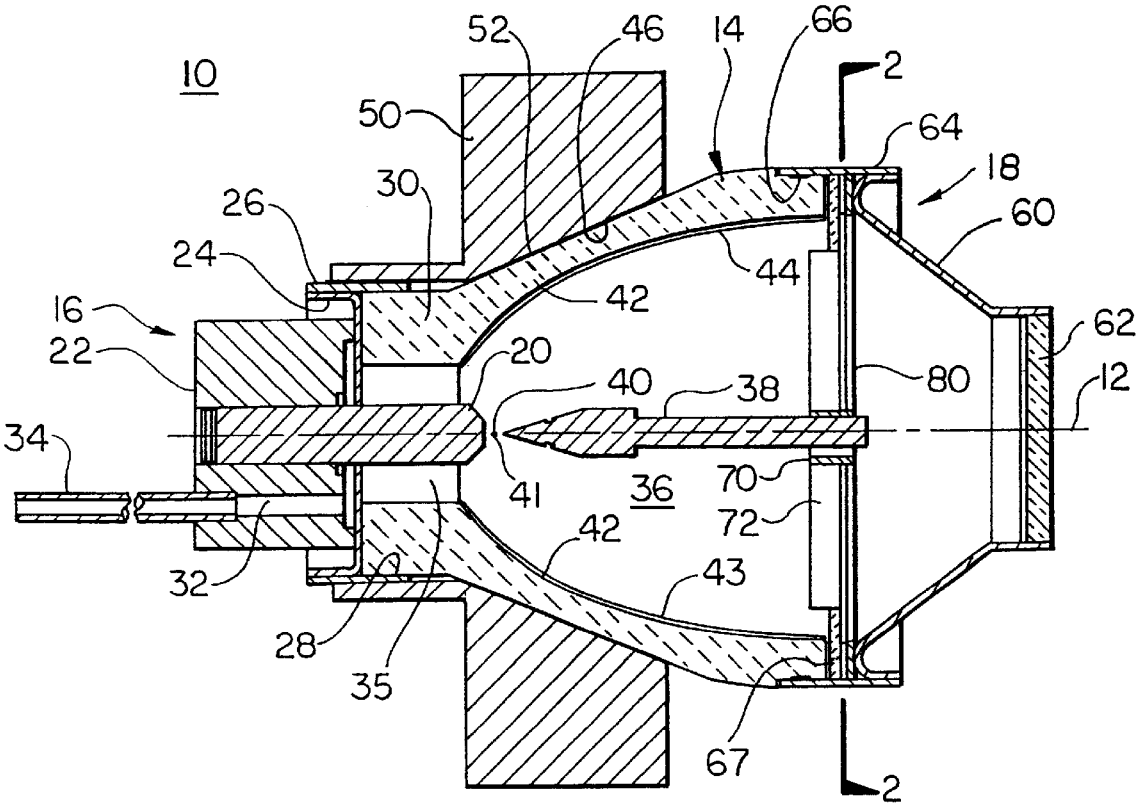
FIG. 1 is a side sectional view taken along lines 1—1 of FIG. 2. of a high power short arc circularly symmetrical gas discharge lamp according to this invention.
Figure 2:
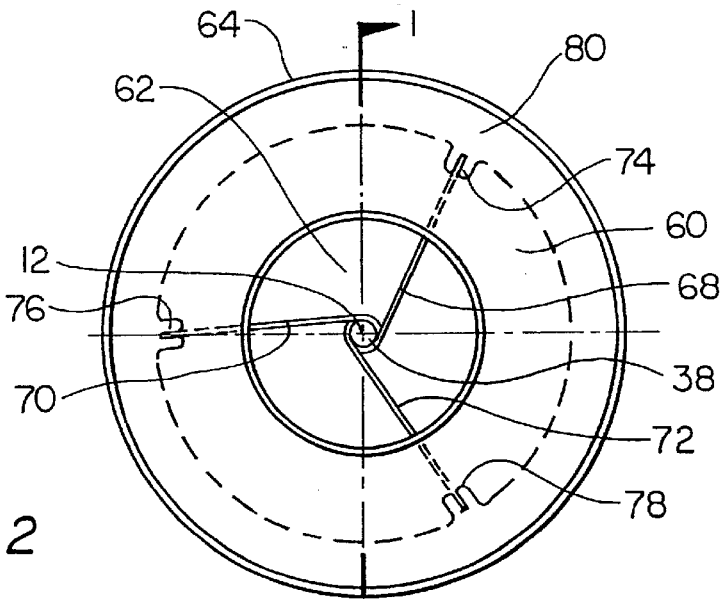
FIG. 2 is an end view of the lamp taken along line 2—2 of FIG. 1.
Figure 3:
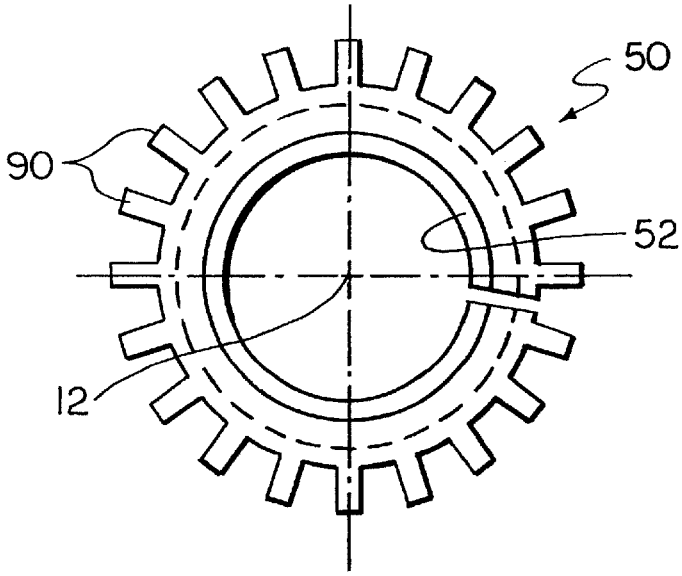
FIG. 3 is an end view of the heat sink of FIG. 1.

There is shown in FIGS. 1, 2 and 3 a high power short arc gas discharge lamp 10, FIG. 1, in accordance with one embodiment of this invention. Lamp 10 is symmetrically circular about center line 12, FIG. 1. Lamp 10 includes a reflector body 14 made of a ceramic such as high alumina which is a good electrical insulator but a poor thermal conductor. Lamp 10 includes an anode assembly 16 at one end of reflector body 14 and a cathode assembly 18 at the other end.

Anode assembly 16 includes an anode 20 of tungsten mounted in a copper anode base 22 which serves as a first heat sink. Copper anode base 22 is brazed to Kovar anode ring 24 which is welded to Kovar anode ring 26, which in turn is brazed such as at joint 28 to the anode end 30 of reflector body 14. Base 22 includes channel 32 which receives copper exhaust port 34 and communicates with the interior of chamber 36 through bore 35 in reflector body 14. Exhaust port 34 is used to evacuate chamber 36 and then to fill it with a discharge gas such as xenon or argon at high pressure, typically in the range of 14 atmospheres, after which exhaust port 34 is plugged or pinched closed.

Cathode assembly 18 includes cathode 38, made of, for example, thoriated tungsten, in chamber 36 at a short distance, typically 1–3 mm, from anode 20 so that an arc can be struck in the gap 40 between them. The heat is most intense in the area of gap 40 which typically operates at 15–20 volts and 20–50 amps with a trigger voltage of 30,000 volts. In the area radially outward from gap 40, namely area 42, the thickness of reflector body 14 is at a minimum because the inner concave surface 44 which is elliptical or parabolic, is confronted with an outer surface 46 which is conical, producing a necking effect or waist in area 42. This reduces the cross sectional area of reflector body 14 to a minimum in area 42 and thus minimizes the effect of its poor thermal conduction. To capitalize on the reduction of the reflector body 14 wall thickness at this point, an external electrically isolated second heat sink 50 having a conforming conical surface 52 is intimately engaged with conical surface 46 so the heat is conducted directly from the heat producing area of gap 40 in the shortest dimension through reflector body 14 in the area 42 and into a large external heat sink 50 which is electrically isolated from the anode and the cathode and extends radially outwardly into the path of free air surrounding lamp 10 for increased heat dissipation. Arc gap 40 is located proximate a focal point 41 of reflective surface 44 inside reflector body 14 which may include, for example, a highly reflective silver coating 43.

Cathode assembly 18 includes a Kovar window collar 60 which includes a sapphire window 62 approximately ⅛ inch thick through which the light generated proximate focal point 41 is beamed out of lamp 10. Kovar collar 60 is welded to cathode Kovar ring 64 which in turn is brazed as at 66 to reflector body 14. A ceramic spacer 67 is used to insulate conductive silver coating 43 from the rest of cathode assembly 18. Cathode assembly 18 also includes three legs 68, 70 and 72, shown more clearly in FIG. 2, which are brazed or otherwise fastened to mounts 74, 76 and 78, respectively, in Kovar retainer ring 80 and converge at the center to support cathode 38.

Figure 4:
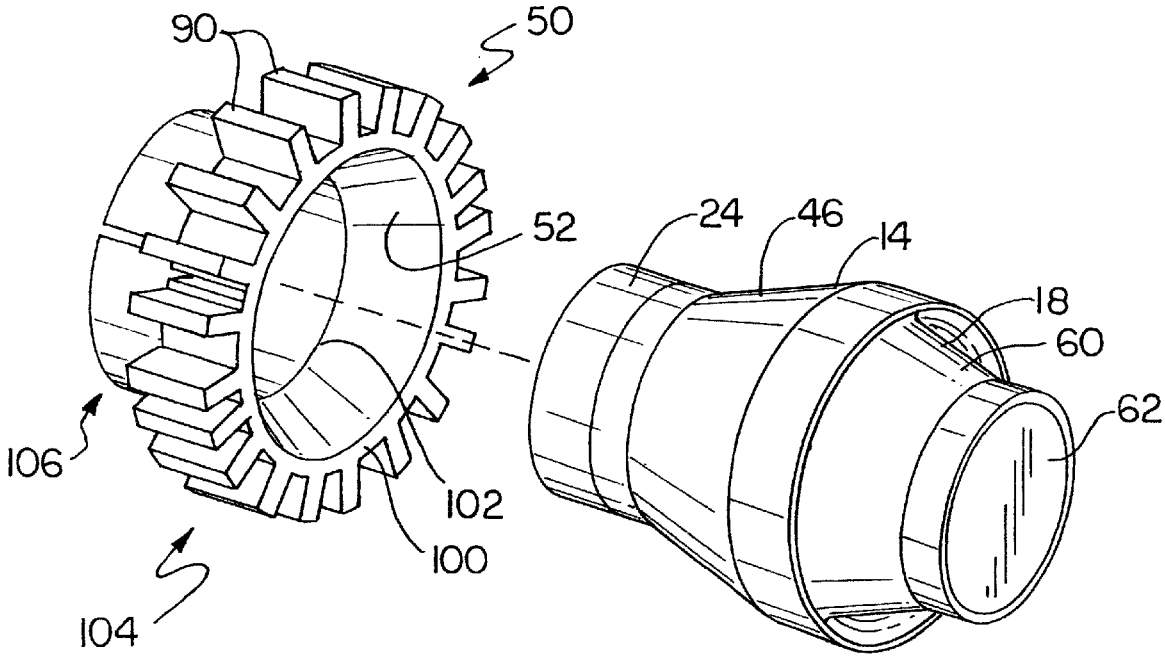
FIG. 4 is a schematic assembly view of the gas discharge lamp of this invention.

Heat sink 50, FIG. 1, includes a plurality of radially extending fins 90, FIGS. 3–4, which conduct the heat directly from the area proximate gap 40 through the thinned area 42 of reflector body 14 and radially outward to the external free air environment surrounding lamp 10. As shown in FIG. 4, heat sink 50 fits over conical outer surface 46 of reflector body 14. Heat sink 50 is typically made of copper and opening 100 in this embodiment is 1.815 inches tapering down to 1.312 inches at point 102. head section 104 is 0.750 inch long and collar section 106 is 0.500 inch long. Fins 90 are 0.125 inch thick and 0.250 inch high.

Thus, in this invention the electrically insulative but poor heat conductive ceramic reflective body 14, FIG. 1, is made thinnest proximate the point where the most heat is generated, namely, proximate arc gap 40. Then, heat sink 50 is circumferentially disposed about the thinnest portion of ceramic reflective body 14 to provide a more thermally efficient high power short arc gas discharge lamp which reduces the possibility of electrode erosion and catastrophic failure.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A high power short arc gas discharge lamp comprising:

an electrically isolating reflector body having a concave internal reflector surface with a focal point;

an anode and a cathode spaced from said anode to create an arc gap between them proximate said focal point;

said reflector body having a conical external surface, exposed to the environment, for reducing the thickness of said reflector body between the concave internal surface and the conical external surface to a minimum thickness proximate said arc gap; and an external electrically isolated non-enclosed heat sink in conforming engagement with said external conical surface proximate said arc gap.

2. The high power short arc gas discharge lamp of claim 1 in which said internal reflector is a parabolic surface.

3. The high power short arc gas discharge lamp of claim 1 in which said internal reflector is an elliptical surface.

4. The high power short arc gas discharge lamp of claim 1 in which the reflector body thickness is reduced proximate said arc gap.

5. The high power short arc gas discharge lamp of claim 1 in which said heat sink includes a conical mounting surface for conformingly engaging said conical external surface.

6. The high power short arc gas discharge lamp of claim 1 in which said heat sink includes a plurality of spaced fins.

7. The high power short arc gas discharge lamp of claim 1 in which said heat sink is annular.

8. The high power short arc gas discharge lamp of claim 1 in which said heat sink extends longitudinally along said reflector body and radially outwardly from said arc gap.

* * * * *